US012674226B2

(12) United States Patent
Yoshikawa et al.

(10) Patent No.: US 12,674,226 B2
(45) Date of Patent: Jul. 7, 2026

(54) STEEL SHEET AND ENAMELED PRODUCT

(71) Applicant: NIPPON STEEL CORPORATION, Tokyo (JP)

(72) Inventors: Nobuo Yoshikawa, Tokyo (JP); Takashi Aramaki, Tokyo (JP); Tetsuji Fukuzato, Tokyo (JP); Kazuhisa Kusumi, Tokyo (JP); Hisayoshi Yatoh, Tokyo (JP); Yoshinari Yano, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 646 days.

(21) Appl. No.: 17/909,706

(22) PCT Filed: Mar. 26, 2021

(86) PCT No.: PCT/JP2021/013017
§ 371 (c)(1),
(2) Date: Sep. 6, 2022

(87) PCT Pub. No.: WO2021/193953
PCT Pub. Date: Sep. 30, 2021

(65) Prior Publication Data

US 2023/0160046 A1 May 25, 2023

(30) Foreign Application Priority Data

Mar. 27, 2020 (JP) ..... 2020-057125

(51) Int. Cl.

| | |
|---|---|
| ***C22C 38/60*** | (2006.01) |
| ***C21D 7/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/20*** | (2006.01) |
| ***C22C 38/22*** | (2006.01) |
| ***C22C 38/26*** | (2006.01) |
| ***C22C 38/28*** | (2006.01) |
| ***C22C 38/32*** | (2006.01) |
| ***C22C 38/40*** | (2006.01) |

(52) U.S. Cl.
CPC ..... *C22C 38/60* (2013.01); *C21D 7/02* (2013.01); *C22C 38/001* (2013.01); *C22C 38/002* (2013.01); *C22C 38/004* (2013.01); *C22C 38/005* (2013.01); *C22C 38/008* (2013.01); *C22C 38/02* (2013.01); *C22C 38/04* (2013.01); *C22C 38/06* (2013.01); *C22C 38/20* (2013.01); *C22C 38/22* (2013.01); *C22C 38/26* (2013.01); *C22C 38/28* (2013.01); *C22C 38/32* (2013.01); *C22C 38/40* (2013.01)

(58) Field of Classification Search
CPC ..... C21D 6/005; C21D 6/008; C21D 7/02; C21D 8/02; C21D 8/0226; C21D 8/0236; C21D 9/46; C22C 38/00; C22C 38/001; C22C 38/002; C22C 38/004; C22C 38/005; C22C 38/008; C22C 38/02; C22C 38/04; C22C 38/06; C22C 38/08; C22C 38/16; C22C 38/18; C22C 38/20; C22C 38/22; C22C 38/26; C22C 38/28; C22C 38/32; C22C 38/34; C22C 38/38; C22C 38/40; C22C 38/60
See application file for complete search history.

(56) References Cited

U.S. PATENT DOCUMENTS

2016/0201154 A1* 7/2016 Tomokiyo ..... C22C 38/04 420/83

FOREIGN PATENT DOCUMENTS

| | | | | | |
|---|---|---|---|---|---|
| CN | 103210103 | A | * | 7/2013 | ..... B21B 15/00 |
| EP | 3 348 661 | A1 | | 7/2018 | |
| JP | 57-49089 | B2 | | 10/1982 | |
| JP | H116031 | A | * | 1/1999 | |
| JP | H11131185 | A | * | 5/1999 | |
| JP | 2001342542 | A | * | 12/2001 | |
| JP | 2003-96542 | A | | 4/2003 | |
| JP | 6115691 | B1 | | 4/2017 | |
| WO | WO-2017043660 | A1 | * | 3/2017 | ..... C21D 8/0236 |

* cited by examiner

*Primary Examiner* — Jenny R Wu
(74) *Attorney, Agent, or Firm* — Birch, Stewart, Kolasch & Birch, LLP

(57) ABSTRACT

This steel sheet has a predetermined chemical composition, and, on a surface parallel to a surface at a ¼ position of a sheet thickness in a sheet thickness direction from the surface, with respect to a total area of three types of oxides of MnO, $Cr_2O_3$ and $Al_2O_3$ having a major axis of more than 1.0 μm, a total area ratio of the MnO and the $Cr_2O_3$ is 98.0% or more, and an area ratio of the $Al_2O_3$ is 2.0% or less.

7 Claims, No Drawings

STEEL SHEET AND ENAMELED PRODUCT

TECHNICAL FIELD OF THE INVENTION

The present invention relates to a steel sheet and an enameled product.

Priority is claimed on Japanese Patent Application No. 2020-057125, filed Mar. 27, 2020, the content of which is incorporated herein by reference.

RELATED ART

Enameled products have a glassy substance baked on a surface of a steel sheet. Enameled products have functions of heat resistance, weather resistance, chemical resistance, and water resistance and thus have been broadly used as materials for kitchen appliances such as pots and sinks, building materials, and the like in the related art. Such enameled products are usually manufactured by processing steel sheets into predetermined shapes, assembling the steel sheets into a product shape by welding or the like, and then carrying out an enameling treatment (baking treatment) thereon.

Steel sheets that are used as materials for enameled products (steel sheets for vitreous enameling) are demanded to have, as the characteristics, baking strain resistance, fish scaling resistance after an enameling treatment, enamel adhesion, bubble and black point defect resistance after an enameling treatment, and the like.

Fish scaling is a phenomenon in which an enamel layer is damaged and crescent fragments are peeled off for approximately one week after baking. A reason for the occurrence of fish scaling is considered that hydrogen that has intruded into a steel sheet and formed a solid solution in the process of enamel baking or the like turns into a gas after cooling and gathers at the interface between the steel sheet and a glaze, and an enamel layer is fractured due to pressure attributed to the hydrogen gas.

For the prevention of fish scaling, it is considered to be effective to improve the hydrogen storage capacity of steel sheets by increasing the number of inclusions.

For example, Patent Document 1 proposes a manufacturing method of steel for vitreous enameling, in the oxygen content in steel is increased and the steel is continuously cast. Patent Document 1 discloses that a low-carbon, high-oxygen and high-quality material for vitreous enameling in which fish scaling or the like does not occur frequently does not have a surface defect such as a pinhole and a sliver and can be manufactured with a high yield.

However, in Patent Document 1, the amount of oxygen in steel is adjusted by adding Al and carrying out a deoxidation treatment. In a case when the amount of oxygen in steel is adjusted by Al as described above, a number of large non-metal inclusions (10 μm or more) are formed by Al or the like added to molten steel, and it is difficult to sufficiently form a fine oxide that is highly effective for hydrogen storage.

As a countermeasure, Patent Document 2 proposes a cold-rolled steel sheet for direct one-time vitreous enameling that contains Cr 0.5 to 1.3 times more than oxygen (O) and has excellent deep drawability.

However, in Patent Document 2, Al is used as a deoxidizing element. In addition, Cr is an oxide-forming element like Al, but the tendency of Cr is lower than that of Al. Therefore, in the technique of Patent Document 2, a number of large non-metal inclusions are formed, and it is difficult to sufficiently form fine oxides effective for hydrogen storage.

In addition, Patent Document 3 proposes a steel sheet for enameling that contains Mn 2 to 19 times more than oxygen (O), having a small number of surface defects, and is excellent in terms of fish scaling resistance, adhesion, foaming resistance, and workability. In Patent Document 3, it is indicated that a Fe—Mn—O-based inclusion is suitable as a fine inclusion that has an effect on improvement in fish scaling resistance and does not cause any surface defects, and the Fe—Mn—O-based inclusion is formed by suppressing the formation of a large non-metal inclusion.

However, in the technique of Patent Document 3, addition of Ca and/or Mg is essential. In a case where Ca or Mg is added, a number of large non-metal inclusions are formed as in a case where Al is added. In addition, in a composite oxide containing a strong deoxidizing element such as Ca or Mg, voids are less likely to be formed due to a pulverization effect. Therefore, in a case where Ca or Mg is added, there is a problem in that hydrogen storage capacity deteriorates.

In addition, for enameled products, there is a demand for high-strengthening of steel sheets being used for the purpose of the weight reduction of components in some applications. Since an enameling treatment is a baking treatment, there are cases where the strengths of steel sheets decrease due to grain growth or the like; however, in a case where the application of enameled products to the above-described applications is taken into account, a decrease in tensile strength due to the enameling treatment is preferably as small as possible.

For example, Patent Document 4 discloses a steel sheet containing an oxide containing Fe and Mn, in which, in the oxide, the number density of the oxide having a diameter of more than 1.0 μm and 10 μm or less is $1.0\times10^3/mm^2$ or more and $5.0\times10^4/mm^2$ or less, and the number density of the oxide having a diameter of 0.1 to 1.0 μm is $5.0\times10^3/mm^2$ or more. Patent Document 4 describes that, after an enameling treatment, excellent enamel characteristics (fish scaling resistance, adhesion, and external appearance) and excellent strength characteristics (characteristics that do not cause a decrease in tensile strength due to enameling treatments or that are capable of stably suppressing a decrease in tensile strength due to enameling treatments) can be obtained.

However, Patent Document 4 has a problem that it is necessary for a number of mainly angular oxides to be present in the steel sheet and workability is not sufficient for severe processes such as deep drawing.

PRIOR ART DOCUMENT

Patent Document

[Patent Document 1] Japanese Examined Patent Application, Second Publication No. S57-49089

[Patent Document 2] Japanese Unexamined Patent Application, First Publication No. 2001-342542

[Patent Document 3] Japanese Unexamined Patent Application, First Publication No. 2003-96542

[Patent Document 4] Japanese Patent No. 6115691

DISCLOSURE OF THE INVENTION

Problems to be Solved by the Invention

An object of the present invention is to solve the above-described problems and to provide a steel sheet having excellent enamel characteristics (fish scaling resistance, adhesion (enamel adhesion), and external appearance) after an enameling treatment and an enameled product including this steel sheet and having excellent enamel characteristics.

In addition, a preferable object of the present invention is to provide a steel sheet having excellent enamel characteristics (fish scaling resistance, adhesion, and external appearance) after an enameling treatment and capable of suppressing a decrease in tensile strength due to the enameling treatment and an enameled product including this steel sheet and having excellent enamel characteristics.

Means for Solving the Problem

The present inventors repeated a variety of studies in order to overcome the problems of conventional steel sheets for vitreous enameling. In particular, means for improving the fish scaling resistance of steel sheets after an enameling treatment with an assumption that the adhesion and external appearance of enamel have been made more favorable than ever was studied with attention paid to the influence of the chemical composition and the manufacturing conditions. As a result, the following findings were obtained.

(a) In order to improve the fish scaling resistance, it is preferable to suppress the formation of a large inclusion, particularly, $Al_2O_3$ and to precipitate a large amount of a fine inclusion. As the fine inclusion, MnO or $Cr_2O_3$ is suitable.

(b) In the manufacturing of steel for vitreous enameling, normally, steel is roughly decarburized in a converter and then decarburized with a vacuum degassing device such as RH. Usually, in vacuum decarburization, in order to improve the decarburization rate, the oxygen concentration is increased, and Al is injected as a deoxidizing agent after decarburization. A large amount of a large inclusion is formed during this deoxidation. On the other hand, Mn and Cr having a small deoxidation power are added before deoxidation with Al and deoxidation with Al is carried out after a fine inclusion is formed, whereby the formation of a large inclusion can be suppressed.

The present invention has been made in view of the above-described findings. The gist of the present invention is as described below.

[1] A steel sheet according to one aspect of the present invention containing, as a chemical composition, by mass %, C: 0.0050% or less, Si: 0.050% or less, Mn: 0.007% to 1.00%, P: 0.003% to 0.050%, S: 0.005% to 0.050%, Al: 0.010% or less, O: 0.0300% to 0.1000%, Cu: 0.010% to 0.060%, N: 0.0050% or less, Cr: 0.01% to 1.00%, and a remainder of Fe and an impurity, in which, on a plane parallel to a surface at a ¼ position of a sheet thickness in a sheet thickness direction from the surface, with respect to a total area of three types of oxides of MnO, $Cr_2O_3$ and $Al_2O_3$ having a major axis of more than 1.0 μm, a total area ratio of the MnO and the $Cr_2O_3$ is 98.0% or more, and an area ratio of the $Al_2O_3$ is 2.0% or less.

[2] The steel sheet according to the above [1], in which a total number density of the MnO and the $Cr_2O_3$ having a major axis of more than 1.0 μm and 10 μm or less may be $5.0\times10^2/mm^2$ or more and $5.0\times10^4/mm^2$ or less.

[3] The steel sheet according to the above [1] or [2], in which a number density of MnO having a major axis of 0.1 to 1.0 μm may be $1.0\times10/mm^2$ or more and $5.0\times10^2/mm^2$ or less.

[4] The steel sheet according to any one of the above [1] to [3] may further contains, as the chemical composition, by mass %, a total of 0.100% or less of one or more selected from the group consisting of B, Ni, Nb, As, Ti, Se, Ta, W, Mo, Sn, Sb, La, Ce, Ca, and Mg.

[5] The steel sheet according to any one of the above [1] to [4], in which, when, by mass %, a Cu content is indicated by [Cu], a P content is indicated by [P], and a S content is indicated by [S], [Cu]/[P] is 1.0 to 4.0, and [P]/[S] is 0.2 to 2.0.

[6] The steel sheet according to any one of the above [1] to [5] may be a cold-rolled steel sheet.

[7] The steel sheet according to any one of the above [1] to [6] may be a steel sheet for vitreous enameling.

[8] An enameled product according to another aspect of the present invention including the steel sheet according to any one of [1] to [5].

Effects of the Invention

According to the above-described aspects of the present invention, it is possible to provide a steel sheet being excellent in terms of fish scaling resistance after an enameling treatment, enamel adhesion, and external appearance after an enameling treatment. This steel sheet is preferable as a steel sheet for vitreous enameling that is a substrate for enameled products that are applied to kitchen appliances, building materials, energy fields, and the like.

In addition, according to the above-described aspects of the present invention, it is possible to provide an enameled product having excellent enamel characteristics. This enameled product is suitable for applications such as kitchen appliances, building materials, energy fields, and the like.

EMBODIMENTS OF THE INVENTION

A steel sheet according to an embodiment of the present invention (the steel sheet according to the present embodiment) will be described.

A steel sheet according to the present embodiment contains, as the chemical composition, by mass %, C: 0.0050% or less, Si: 0.050% or less, Mn: 0.007% to 1.00%, P: 0.003% to 0.050%, S: 0.005% to 0.050%, Al: 0.010% or less, O: 0.0300% to 0.1000%, Cu: 0.010% to 0.060%, N: 0.0050% or less, Cr: 0.01% to 1.00%, and the remainder of Fe and an impurity, on a plane parallel to the surface at a ¼ position of a sheet thickness in the sheet thickness direction from the surface, with respect to the total area of three types of oxides of MnO, $Cr_2O_3$ and $Al_2O_3$ having a major axis of more than 1.0 μm, the total area ratio of the MnO and the $Cr_2O_3$ is 98.0% or more, and the area ratio of the $Al_2O_3$ is 2.0% or less. Preferably, the total number density of MnO and $Cr_2O_3$ having a major axis of more than 1.0 μm and 10 μm or less is $5.0\times10^2/mm^2$ or more and $5.0\times10^4/mm^2$ or less. In addition, preferably, the number density of MnO having a major axis of 0.1 to 1.0 μm is $1.0\times10/mm^2$ or more and $5.0\times10^2/mm^2$ or less.

<Chemical Composition>

First, the reasons for limiting the chemical composition will be described. Hereinafter, "%" regarding the chemical composition indicates "mass %". In addition, numerical value ranges shown using "to" include values at both ends as the upper and lower limits. For example, "0.007% to 1.00%" indicates "0.007% or more and 1.00% or less". On the other hand, in a case where a numerical value range is shown using "more than" or "less than", the corresponding value is not included as an upper limit or a lower limit.

C: 0.0050% or Less

As the C content becomes higher, there is a tendency that a bubble defect is more likely to be generated in enamel, and the press formability also becomes poorer. The C content is preferably as low as possible in terms of the product performance, but excessive reduction in C extends a treatment time in a steelmaking stage and also increases the steelmaking cost. Therefore, the C content is set to 0.0050% or less. The C content is preferably 0.0020% or less.

Si: 0.050% or Less

When the Si content is high, there is a case where enamel characteristics are impaired, and, at the same time, a large amount of a Si oxide is formed by hot rolling, which degrades the fish scaling resistance. This influence becomes significant when the Si content exceeds 0.050%, and thus the Si content is set to 0.050% or less. The Si content is preferably set to 0.008% or less from the viewpoint of improving the bubble defect resistance, the black point defect resistance, and the like and obtaining more favorable surface properties after an enameling treatment.

Mn: 0.007% to 1.00%

Mn is an element that forms an oxygen-containing inclusion and contributes to improvement in enamel characteristics. In addition, Mn is also an element having an action of preventing hot embrittlement attributed to S. In order to obtain these effects, the Mn content is set to 0.007% or more. The Mn content is preferably 0.10% or more.

On the other hand, Mn is also an element having an action of lowering the transformation point of steel, and, when the Mn content is excessive, transformation occurs in a baking temperature range in the enameling treatment, baking strain is generated, and distortion of products is caused. In addition, when the Mn content becomes excessive, the workability of steel deteriorates. Therefore, the Mn content is set to 1.00% or less. The Mn content is preferably 0.50% or less.

P: 0.003% to 0.050%

P is an element having an effect of increasing the pickling weight loss of the steel sheet at the time of pickling, which is a pretreatment for enameling. When the P content is less than 0.003%, pickling becomes insufficient, and the adhesion of enamel is impaired. Therefore, the P content is set to 0.003% or more. The P content is preferably 0.005% or more.

On the other hand, when the P content exceeds 0.050%, the pickling weight loss becomes excessive, and a bubble or black point defect is likely to be generated after the enameling treatment. In order to avoid these, the P content is set to 0.050% or less. The P content is preferably 0.035% or less.

S: 0.005% to 0.050%

S is an element that accelerates the pickling rate, roughens the surface of the steel sheet after pickling, and contributes to improvement in enamel adhesion. In order to obtain these effects, the S content is set to 0.005% or more.

On the other hand, when the S content becomes excessive, there is a case where an effect of Mn necessary to control oxides in steel deteriorates. Therefore, the S content is set to 0.050% or less.

Al: 0.010% or Less

Al is a strong deoxidizing element, and, in the steel sheet according to the present embodiment, it is necessary to carefully control the Al content. When the Al content exceeds 0.010%, it becomes difficult to retain a necessary amount of 0 in steel, and it becomes difficult to control oxides that are effective for the fish scaling resistance. Therefore, the Al content is set to 0.010% or less. The Al content is preferably 0.005% or less.

The lower limit of the Al content does not need to be limited, and the Al content may be 0.001% or more.

O: 0.0300% to 0.1000%

O is a constituent element of a fine inclusion that captures hydrogen in steel and improves the fish scaling resistance and is an important element in steel sheets for vitreous enameling. In the steel sheet according to the present embodiment, the O content is set to 0.0300% or more in order to secure desired enamel characteristics. When the O content is less than 0.0300%, the number of inclusions becomes insufficient, and fish scaling defects are frequently generated. The O content is preferably 0.0400% or more.

On the other hand, when the O content becomes excessively high, the ductility deteriorates. Therefore, the O content is set to 0.1000% or less.

Cu: 0.010% to 0.060%

Cu is an element that decreases the pickling weight loss, but improves enamel adhesion by forming fine unevenness on the surface of the steel sheet after pickling. In order to obtain this effect, the Cu content is set to 0.010% or more. When the Cu content is less than 0.010%, the enamel adhesion improvement effect is not sufficient. The Cu content is preferably 0.020% or more.

On the other hand, when the Cu content exceeds 0.060%, the dissolution rate of steel in pickling becomes too slow, and the unevenness is not sufficiently formed. As a result, it is not possible to obtain favorable adhesion. Therefore, the Cu content is set to 0.060% or less. The Cu content is preferably 0.050% or less.

N: 0.0050% or Less

N is an impurity and is an element that causes strain ageing. When strain ageing is caused, the workability of the steel sheet is impaired. Therefore, the N content is preferably as small as possible, but excessive reduction in N extends a treatment time in a steelmaking stage and also increases the steelmaking cost. Therefore, the N content is set to 0.0050% or less.

Cr: 0.01% to 1.00%

Cr is an element that forms an O-containing inclusion and contributes to improvement in enamel characteristics. Particularly, in a case where Cr and Mn are contained in a combined manner, oxides have appropriate sizes, and the occurrence of fish scaling after the enameling treatment is suppressed compared with a case where Cr and Mn are not contained. When the Cr content is less than 0.01%, the effect of the composite oxide with Mn cannot be obtained. Therefore, the Cr content is set to 0.01% or more. The Cr content is preferably 0.03% or more.

On the other hand, when the Cr content exceeds 1.00%, the workability deteriorates, and the black point defect resistance is also impaired. Therefore, the Cr content is set to 1.00% or less. The Cr content is preferably 0.50% or less, more preferably 0.30% or less, and still more preferably 0.08% or less.

The chemical composition of the steel sheet according to the present embodiment basically contains the above-described elements and the remainder consisting of Fe and an impurity. The impurity means a component that is incorporated from a raw material such as an ore or a scrap or from a variety of causes in manufacturing steps during the industrial manufacturing of a steel material and is allowed to be contained as long as the impurity does not adversely affect the steel sheet according to the present embodiment.

In the steel sheet according to the present embodiment, among the elements contained as the impurity, for B, Ni, Nb, As, Ti, Se, Ta, W, Mo, Sn, Sb, La, Ce, Ca, and Mg, the contents thereof are preferably controlled within ranges to be described below.

Total of one or more of B, Ni, Nb, As, Ti, Se, Ta, W, Mo, Sn, Sb, La, Ce, Ca, and Mg: 0.100% or less B, Ni, Nb, As, Ti, Se, Ta, W, Mo, Sn, Sb, La, Ce, Ca, and Mg are elements that do not need to be positively contained and impurities that can be inevitably incorporated. Usually, these elements are not often incorporated alone, and two or more elements, for example, Ni and Mo, are often incorporated. When these elements are excessively contained, it becomes impossible to ignore a reaction with the oxide-forming elements, and desired oxide control becomes difficult. Therefore, the total amount of these elements is preferably limited to 0.100% or less. The total content is more preferably 0.050% or less and still more preferably 0.010% or less.

In addition, in a case where these elements act as deoxidizing elements, there is a case where the value of free oxygen is affected and adjustment of free oxygen becomes difficult. Therefore, the upper limit of the amount of each element is preferably set within a range in which the value of free oxygen in a casting stage is not affected.

The above-described steel composition may be measured by a usual analysis method of steel. For example, the steel composition may be measured using inductively coupled plasma-atomic emission spectrometry (ICP-AES). C and S may be measured using an infrared absorption method after high-frequency induction heating combustion, N may be measured using an inert gas melting-thermal conductivity method, and O may be measured using an inert gas fusion-nondispersive infrared absorption method.

In the steel sheet according to the present embodiment, after the amount of each element is controlled as described above in the chemical composition, furthermore, it is preferable that the amounts of individual elements satisfy the following relationships.

[Cu]/[P]: 1.0 to 4.0

Cu reduces the pickling weight loss, whereas P has an action of increasing the pickling weight loss. In consideration of these mutual influences, in order to further improve the enamel adhesion, [Cu]/[P] ([Cu] indicates the Cu content by "mass %", and [P] indicates the P content by "mass %"), which is the ratio of the Cu content to the P content, is preferably set to 1.0 or more and 4.0 or less. [Cu]/[P] is preferably 1.5 or more and 3.5 or less.

[P]/[S]: 0.2 to 2.0

Both P and S are elements that increase the pickling weight loss, but there is an interaction between P and S in terms of the enamel adhesion, and [P]/[S] ([P] indicates the P content by "mass %", and [S] indicates the S content by "mass %"), which is the content ratio thereof, is preferably 0.2 or more and 2.0 or less since the enamel adhesion stably improves. This effect is considered to be related not only to the pickling weight loss but also to the surface state after pickling.

<Oxide>

The steel sheet according to the present embodiment includes, as oxides, oxides substantially including Mn and/or Cr and O (even when Al, Si, and Ca are inevitably contained, the total amount thereof is 2.0% or less), on a plane parallel to the surface at a ¼ position of the sheet thickness in the sheet thickness direction from the surface, with respect to the total area of three types of oxides of MnO, $Cr_2O_3$ and $Al_2O_3$ having a major axis of more than 1.0 μm, the proportion of the total area of MnO and $Cr_2O_3$ having a major axis of more than 1.0 μm is 98.0% or more, and the proportion of the area of $Al_2O_3$ is 2.0% or less. That is, in the steel sheet according to the present embodiment, these area ratios are specified with attention paid to three oxides of MnO, $Cr_2O_3$, and $Al_2O_3$, which have a large influence on the fish scaling resistance.

Since MnO and $Cr_2O_3$ are fine oxides, MnO and $Cr_2O_3$ causes to generate voids around the oxides during cold rolling, and improve the fish scaling resistance. Therefore, among three types of oxides of MnO, $Cr_2O_3$ and $Al_2O_3$ having a major axis of more than 1.0 μm, the proportion of the total area of MnO and $Cr_2O_3$ having a major axis of more than 1.0 μm is set to 98.0% or more. The proportion of the total area is preferably 99.0% or more.

MnO and $Cr_2O_3$ may be each precipitated alone, may be precipitated as a composite oxide (as an oxide substantially composed of Mn, Cr, and O), or may be precipitated with a sulfide such as MnS in a combined manner. In the present embodiment, even in the case of being precipitated with a sulfide in a combined manner, MnO and $Cr_2O_3$ are counted for the total area of MnO and $Cr_2O_3$.

In addition, the formation of an oxide containing Al, Si, Ca, or the like, which is an element of a deoxidation product is suppressed, whereby the oxides can be finely dispersed by the adjustment of free oxygen during casting. On the other hand, in a case where an oxide containing Al, Si, Ca, or the like is formed as an element of the deoxidation product, it becomes difficult to control the number and sizes of the oxides within desired ranges by the adjustment of free oxygen in the casting process.

However, since $Al_2O_3$ is a coarse oxide, when $Al_2O_3$ is formed, the amount of the oxides decreases, and the fish scaling resistance deteriorates. Therefore, the area ratio of $Al_2O_3$ to the total area of the three types of oxides of MnO, $Cr_2O_3$, and $Al_2O_3$ is set to 2.0% or less. The area ratio of $Al_2O_3$ is preferably 1.0% or less.

The reason for designating the oxides (three types of oxides of MnO, $Cr_2O_3$ and $Al_2O_3$) having a major axis of 1.0 μm or more as the measurement subjects is that the oxides having a major axis of less than 1.0 μm have little influences on enamel characteristics.

In the steel sheet according to the present embodiment, in order to further improve the fish scaling resistance without lowering the strength, the total number density of MnO and $Cr_2O_3$ having a major axis of more than 1.0 μm and 10 μm or less is preferably set to $5.0\times10^2$ to $5.0\times10^4/mm^2$.

When present in the steel sheet, MnO and $Cr_2O_3$ having a major axis of more than 1.0 μm improve the fish scaling resistance. The oxides having a major axis of less than 1.0 μm have a small effect on improvement in the fish scaling resistance. On the other hand, when the number of coarse oxides increases, the number density of the oxides decreases, the hydrogen storage effect becomes small, and the effect on improvement in the fish scaling resistance becomes small. In addition, coarse oxides are likely to act as the starting points of cracks during processing and reduce ductility. Therefore, the total number density of MnO and $Cr_2O_3$ having a major axis of more than 1.0 μm and 10 μm or less is controlled.

In order to improve the fish scaling resistance, the number density of these oxides is preferably set to $5.0\times10^2/mm^2$ or more. The number density of these oxides is more preferably $1.0\times10^3/mm^2$ or more.

On the other hand, when the above-described oxides are present more than $5.0\times10^4/mm^2$, a number of voids are generated more than necessary at the interfaces between the oxides and the steel sheet base metal during processing, and the strength of the steel sheet decreases. Therefore, the number density is preferably set to $5.0\times10^4/mm^2$ or less. The number density is more preferably $1.0\times10^4/mm^2$ or less.

As described above, the oxides having a major axis of less than 1.0 μm have a small influence on enamel characteristics. However, when MnO having a major axis of 0.1 to 1.0

μm is made present $1.0\times10/mm^2$ or more, it is possible to further suppress a decrease in the tensile strength due to the enameling treatment, which is preferable.

On the other hand, when the number density of MnO having a major axis of 0.1 to 1.0 μm exceeds $5.0\times10^2/mm^2$, there is a case where the workability deteriorates, which is not preferable.

In addition, in the case of angular oxides, gaps (voids) are likely to be generated between the oxides and the base steel sheet during pressing, and the workability deteriorates. Therefore, the shapes of the oxides are desirably spherical.

The above-described proportions and number densities of the oxides are measured using Metals Quality Analyzer (MQA: registered trademark). Specifically, in a case where the sheet thickness of the steel sheet is indicated by t, oxides that are present in a 10 mm×10 mm range on a plane parallel to the surface of the steel sheet at a position of t/4 (t: sheet thickness) in the sheet thickness direction from the surface are analyzed.

Cold rolling generates voids at the interfaces between the oxides and the base metal and improves the fish scaling resistance after the enameling treatment. Therefore, the steel sheet according to the present embodiment is preferably a cold-rolled steel sheet.

In addition, the steel sheet according to the present embodiment is excellent in terms of enamel characteristics. Therefore, the steel sheet according to the present embodiment is preferably used as a steel sheet for vitreous enameling, which is a material for enameled products.

In addition, an enameled product according to the present embodiment includes the above-described steel sheet according to the present embodiment. For example, the enameled product according to the present embodiment is an enameled product obtained by carrying out an enameling treatment on the steel sheet according to the present embodiment and processing the steel sheet as necessary.

<Manufacturing Method>

A preferable manufacturing method of the steel sheet according to the present embodiment will be described.

The steel sheet according to the present embodiment can be manufactured by manufacturing a steel piece having the above-described chemical composition by melting, refining, and casting and carrying out hot rolling, cold rolling, annealing, and temper rolling on this steel piece as necessary. Each step needs to be set based on normal methods except conditions to be described below.

[Refining Step]

Usually, in the case of manufacturing a steel sheet for vitreous enameling, deoxidation with Al or Si is carried out at the initial stage of secondary refining. However, in the manufacturing method of a steel sheet according to the present embodiment, one or more of Mn and Cr are added to molten steel after the completion of decarburization and before the deoxidation with Al or Si. When Mn and Cr are added as metals or an alloy to molten steel before the deoxidation with Al or Si, it is possible to set the proportion of the total area of the MnO and the $Cr_2O_3$ having a major axis of more than 1.0 μm to 98.0% or more and the proportion of the area of $Al_2O_3$ is 2.0% or less with respect to the total area of the three types of oxides of MnO, $Cr_2O_3$ and $Al_2O_3$ having a major axis of more than 1.0 μm. The proportions of these oxides rarely change in the subsequent steps.

In addition, when Mn and Cr are added before the deoxidation with Al or Si, it is possible to decrease the activity of MnO and $Cr_2O_3$ compared with that in a case where Mn or Cr is added alone and to stably obtain MnO and $Cr_2O_3$ having a major axis of more than 1.0 μm and 10 μm in a range of $5.0\times10^2$ to $5.0\times10^4/mm^2$.

In addition, when the amount of Al having a strong oxidizing power added is adjusted at the time of adding Al or Si to the molten steel after the addition of Mn and Cr as metals or an alloy, it is possible to control the number density of MnO having a major axis of 0.1 to 1.0 μm.

In addition, the enameled product according to the present embodiment is obtained by processing the steel sheet according to the present embodiment into predetermined shapes, then, assembling the steel sheet pieces into a product shape by welding or the like, and carrying out an enameling treatment (baking treatment). Regarding the enameling treatment, for example, the steel sheet coated with a glaze is heated to a predetermined temperature and held for a predetermined time, thereby causing a glassy substance of the glaze and the steel sheet to adhere together. As preferable baking conditions for the steel sheet according to the present embodiment, for example, it is preferable that the baking temperature is in a range of 750° C. to 900° C. and the baking time is in a range of 1.5 to 10 minutes (in furnace). In addition, baking may be repeated several times for double coating and repair. When a baking treatment is carried out under such conditions, grain growth during the enameling treatment is suppressed by a C solid solution and iron carbide, and it becomes possible to suppress a decrease in the strength. The conditions for the baking treatment described herein are merely examples and do not limit the conditions for the enameling treatment for the steel sheet according to the present embodiment.

EXAMPLES

Example 1

Steels having a chemical composition shown in Table 1 (the remainder was Fe and an impurity) were melted in a converter, in secondary refining, Al, Cr, and Mn were added in the order of B1 or B2 in Table 2, and then continuous casting was carried out to produce slabs.

These slabs were heated at 1150° C. to 1250° C., then, hot-rolled at a finish temperature of 900° C. or higher, and coiled at 600° C. to 700° C. to produce hot-rolled steel sheets. In addition, the hot-rolled steel sheets were pickled and then cold-rolled at a rolling reduction of 70% to 85% to produce cold-rolled steel sheets. The cold-rolled steel sheets were continuously annealed at 650° C. to 750° C. and then temper-rolled to produce steel sheets having a sheet thickness of 0.7 mm (cold-rolled steel sheets).

TABLE 1

| Steel | Chemical component (mass %), remainder: Fe and impurity | | | | | | | | | | | | |
|---|---|---|---|---|---|---|---|---|---|---|---|---|---|
| No. | C | Si | Mn | P | S | Al | O | Cu | Cr | N | Others | [Cu]/[P] | [P]/[S] |
| A1 | 0.0050 | 0.008 | 0.23 | 0.025 | 0.034 | 0.002 | 0.0712 | 0.035 | 0.22 | 0.0028 | | 1.4 | 0.7 |
| A2 | 0.0028 | 0.050 | 0.28 | 0.013 | 0.022 | 0.003 | 0.0588 | 0.028 | 0.61 | 0.0025 | Nb: 0.03, Ti: 0.03 | 2.2 | 0.6 |

TABLE 1-continued

| Steel | Chemical component (mass %), remainder: Fe and impurity | | | | | | | | | | | | |
|---|---|---|---|---|---|---|---|---|---|---|---|---|---|
| No. | C | Si | Mn | P | S | Al | O | Cu | Cr | N | Others | [Cu]/[P] | [P]/[S] |
| A3 | 0.0012 | 0.003 | 0.007 | 0.005 | 0.008 | 0.004 | 0.0655 | 0.020 | 0.06 | 0.0013 | Mg: 0.005, As: 0.002 | 4.0 | 0.6 |
| A4 | 0.0011 | 0.015 | 1.00 | 0.019 | 0.013 | 0.003 | 0.0801 | 0.028 | 0.12 | 0.0018 | B: 0.005, Mg: 0.01 | 1.5 | 1.5 |
| A5 | 0.0019 | 0.006 | 0.42 | 0.003 | 0.007 | 0.006 | 0.0376 | 0.013 | 0.27 | 0.0035 | | 4.3 | 0.4 |
| A6 | 0.0032 | 0.007 | 0.22 | 0.050 | 0.026 | 0.002 | 0.0524 | 0.058 | 0.08 | 0.0022 | | 1.2 | 1.9 |
| A7 | 0.0023 | 0.004 | 0.29 | 0.007 | 0.005 | 0.003 | 0.0621 | 0.027 | 0.04 | 0.0028 | | 3.9 | 1.4 |
| A8 | 0.0018 | 0.024 | 0.26 | 0.028 | 0.050 | 0.005 | 0.0456 | 0.029 | 0.19 | 0.0033 | Sn: 0.03, Sb: 0.003 | 1.0 | 0.6 |
| A9 | 0.0028 | 0.009 | 0.34 | 0.004 | 0.038 | 0.010 | 0.0473 | 0.015 | 0.77 | 0.0019 | Ca: 0.004, Se: 0.002 | 3.8 | 0.1 |
| A10 | 0.0014 | 0.013 | 0.65 | 0.028 | 0.048 | 0.006 | 0.0300 | 0.034 | 0.35 | 0.0017 | | 1.2 | 0.6 |
| A11 | 0.0027 | 0.007 | 0.18 | 0.045 | 0.036 | 0.003 | 0.1000 | 0.035 | 0.04 | 0.0022 | Mo: 0.008, W: 0.003, Ta: 0.002 | 0.8 | 1.3 |
| A12 | 0.0019 | 0.004 | 0.41 | 0.004 | 0.013 | 0.004 | 0.0489 | 0.010 | 0.43 | 0.0036 | | 2.5 | 0.3 |
| A13 | 0.0013 | 0.003 | 0.32 | 0.022 | 0.019 | 0.002 | 0.0577 | 0.060 | 0.18 | 0.0019 | Ni: 0.05 | 2.7 | 1.2 |
| A14 | 0.0028 | 0.036 | 0.76 | 0.011 | 0.012 | 0.007 | 0.0545 | 0.028 | 0.01 | 0.0028 | | 2.5 | 0.9 |
| A15 | 0.0013 | 0.005 | 0.21 | 0.027 | 0.020 | 0.005 | 0.0421 | 0.043 | 0.50 | 0.0016 | | 1.6 | 1.4 |
| A16 | 0.0027 | 0.008 | 0.55 | 0.041 | 0.019 | 0.003 | 0.0746 | 0.052 | 0.26 | 0.0050 | La: 0.001, Ce: 0.07 | 1.3 | 2.2 |
| A17 | 0.0018 | 0.002 | 0.28 | 0.012 | 0.018 | 0.005 | 0.0547 | 0.028 | 0.06 | 0.0024 | | 2.3 | 0.7 |
| A18 | 0.0015 | 0.003 | 0.37 | 0.018 | 0.012 | 0.004 | 0.0636 | 0.033 | 0.05 | 0.0022 | | 1.8 | 1.5 |
| a1 | 0.0100 | 0.004 | 0.12 | 0.015 | 0.016 | 0.004 | 0.0435 | 0.031 | 0.31 | 0.0021 | | 2.1 | 0.9 |
| a2 | 0.0014 | 0.062 | 0.42 | 0.012 | 0.019 | 0.002 | 0.0548 | 0.034 | 0.17 | 0.0011 | | 2.8 | 0.6 |
| a3 | 0.0029 | 0.003 | 0.004 | 0.011 | 0.008 | 0.003 | 0.0787 | 0.022 | 0.21 | 0.0042 | | 2.0 | 1.4 |
| a4 | 0.0019 | 0.036 | 1.28 | 0.036 | 0.019 | 0.002 | 0.0473 | 0.052 | 0.05 | 0.0038 | | 1.4 | 1.9 |
| a5 | 0.0021 | 0.004 | 0.65 | 0.002 | 0.022 | 0.003 | 0.0543 | 0.016 | 0.09 | 0.0016 | | 8.0 | 0.09 |
| a6 | 0.0018 | 0.017 | 0.29 | 0.065 | 0.018 | 0.005 | 0.0564 | 0.028 | 0.47 | 0.0021 | | 0.4 | 3.6 |
| a7 | 0.0012 | 0.002 | 0.35 | 0.022 | 0.004 | 0.004 | 0.0489 | 0.047 | 0.69 | 0.0046 | | 2.1 | 5.5 |
| a8 | 0.0017 | 0.024 | 0.47 | 0.006 | 0.067 | 0.002 | 0.0531 | 0.018 | 0.13 | 0.0019 | | 3.0 | 0.09 |
| a9 | 0.0014 | 0.005 | 0.31 | 0.014 | 0.250 | 0.021 | 0.0639 | 0.022 | 0.04 | 0.0025 | | 1.6 | 0.06 |
| a10 | 0.0032 | 0.003 | 0.29 | 0.029 | 0.032 | 0.003 | 0.0233 | 0.013 | 0.26 | 0.0034 | | 0.4 | 0.9 |
| a11 | 0.0013 | 0.008 | 0.53 | 0.034 | 0.019 | 0.005 | 0.1276 | 0.055 | 0.81 | 0.0016 | | 1.6 | 1.8 |
| a12 | 0.0027 | 0.006 | 0.33 | 0.016 | 0.013 | 0.007 | 0.0623 | 0.004 | 0.06 | 0.0011 | | 0.3 | 1.2 |
| a13 | 0.0018 | 0.017 | 0.37 | 0.011 | 0.016 | 0.004 | 0.0545 | 0.102 | 0.19 | 0.0038 | | 9.3 | 0.7 |
| a14 | 0.0019 | 0.003 | 0.66 | 0.021 | 0.022 | 0.002 | 0.0497 | 0.035 | 0.003 | 0.0023 | | 1.7 | 1.0 |
| a15 | 0.0015 | 0.009 | 0.39 | 0.019 | 0.019 | 0.006 | 0.0413 | 0.023 | 1.34 | 0.0026 | | 1.2 | 1.0 |
| a16 | 0.0027 | 0.011 | 0.22 | 0.004 | 0.009 | 0.003 | 0.0577 | 0.014 | 0.35 | 0.0061 | Sn: 0.04, Sb: 0.03, Mo: 0.035 | 3.5 | 0.4 |

TABLE 2

| Refining | Order of elements added to molten steel after decarburization | |
|---|---|---|
| No. | 1 | 2 |
| B1 | Cr, Mn | Al |
| B2 | Al | Cr, Mn |

In the obtained steel sheets, oxides that were present in a 10 mm×10 mm range on a plane parallel to the surface of the steel sheet at a position of t/4 (t: sheet thickness) in the sheet thickness direction from the surface were analyzed using Metals Quality Analyzer (MQA: registered trademark), and the proportions of the oxides were measured.

The results are shown in Table 3.

In addition, for the obtained steel sheets, the enamel characteristics (fish scaling resistance, enamel adhesion, and external appearance after an enameling treatment) were evaluated as described below. The results are shown in Table 3.

[Fish Scaling Resistance]

As a pretreatment, a sample having sizes of 150 mm×100 mm was collected from the steel sheet, and the sample was alkali-degreased, then, immersed in 15 g/l of a nickel sulfate solution at 70° C. for 7 minutes, and then neutralized. After that, a 102 # glaze manufactured by Ferro Enamels (Japan) Limited was glazed 100 μm on both surfaces and baked at 860° C. for 5 minutes in an atmosphere having a dew point of 35° C.

The baked sample was heated by being held at 150° C. for 20 hours, and the status of the occurrence of fish scaling was visually observed and evaluated. The occurrence status was evaluated by the average of four samples. The evaluation criteria were as described below, "A" indicates "excellent", "B" indicates "normal", C indicates "problematic", and C was regarded as fail.

A: The number of fish scales generated per surface is 10 or less.

B: The number of fish scales generated per surface is 11 to 20.

C: The number of fish scales generated per surface is 21 or more.

[Enamel Adhesion]

As a pretreatment, four samples having sizes of 150 mm×100 mm were collected from the steel sheet, and the samples were alkali-degreased, then, immersed in a 10% sulfuric acid solution at 70° C. for 10 minutes, then, immersed in 15 g/l of a nickel sulfate solution at 70° C. for 7 minutes, and then neutralized. Furthermore, a 102 # glaze manufactured by Ferro Enamels (Japan) Limited was glazed 100 μm on both surfaces and baked at 860° C. for 5 minutes in an atmosphere having a dew point of 35° C.

A weight with a 2 kg sphere head was dropped from a height of 1 m onto the baked sample, and the enamel peeling status of the distorted portion was measured with 169 palpation needles and evaluated with the area ratio of the unpeeled portion. The area ratio was evaluated by the average of four samples.

The evaluation criteria were as described below, "A" indicates "excellent", "B" indicates "normal", C indicates "problematic", and C was regarded as fail.

A: The area ratio of the unpeeled portion is 90% or more.

B: The area ratio of the unpeeled portion is 40% or more and less than 90%.

C: The area ratio of the unpeeled portion is less than 40%.

[External Appearance]

As a pretreatment, 10 samples having sizes of 150 mm×100 mm were collected from the steel sheet, and the samples were alkali-degreased, then, immersed in 15 g/l of a nickel sulfate solution at 70° C. for 7 minutes, and then neutralized. Furthermore, a 102 # glaze manufactured by Ferro Enamels (Japan) Limited was glazed 100 μm on both surfaces and baked at 860° C. for 5 minutes in an atmosphere having a dew point of 35° C.

The external appearance of the baked sample was visually observed, and the bubble and black point status was evaluated. In a case where a bubble and a black point were generated in 3 or more of 10 sheets, a bubble and a black point were regarded as being generated, and, in a case where a bubble and a black point were generated in 2 or less of 10 sheets, the external appearance was regarded as having no problems.

As is clear from Table 1 to Table 3, in C1 to C18, which were invention examples, since the chemical composition and the oxides were within the scope of the present invention, the enamel characteristics were excellent.

On the other hand, in c1 to c20, which were comparative examples, the enamel characteristics were poor.

When C4 in which A4 containing 0.12% of Cr was used, C6 in which A6 containing 0.08% of Cr was used, C17 in which A17 containing 0.06% of Cr was used, and c17 were compared, in the sample C4, a black point was generated in 2 of 10 sheets, and, in all of the samples C6, C17, and c17, no black points were observed.

Example 2

Cr, Mn, and Al were added in the addition order shown in the refining No. B1 in Table 2, and slabs having a chemical composition of Steel No. A5, A9, All, or A17 in Table 1 were obtained.

From these slabs, steel sheets were manufactured under the same conditions as in Example 1.

TABLE 3

| | | | | Area ratio of oxides having major axis of more than 1.0 μm | | Enamel characteristics | | |
|---|---|---|---|---|---|---|---|---|
| | Sign | Steel No. | Refining No. | MnO + $Cr_2O_3$ (%) | $Al_2O_3$ (%) | Fish scaling resistance | Adhesion | External appearance |
| Invention Example | C1 | A1 | B1 | 99.5 | 0.5 | A | A | No problem |
| | C2 | A2 | B1 | 99.3 | 0.7 | A | A | No problem |
| | C3 | A3 | B1 | 99.1 | 0.9 | A | A | No problem |
| | C4 | A4 | B1 | 99.3 | 0.7 | A | A | No problem |
| | C5 | A5 | B1 | 98.8 | 1.2 | B | B | No problem |
| | C6 | A6 | B1 | 99.5 | 0.5 | A | A | No problem |
| | C7 | A7 | B1 | 99.3 | 0.7 | A | A | No problem |
| | C8 | A8 | B1 | 99.0 | 1.0 | A | A | No problem |
| | C9 | A9 | B1 | 98.1 | 1.9 | B | B | No problem |
| | C10 | A10 | B1 | 98.8 | 1.2 | A | A | No problem |
| | C11 | A11 | B1 | 99.3 | 0.7 | A | B | No problem |
| | C12 | A12 | B1 | 99.1 | 0.9 | A | A | No problem |
| | C13 | A13 | B1 | 99.5 | 0.5 | A | A | No problem |
| | C14 | A14 | B1 | 98.6 | 1.4 | A | A | No problem |
| | C15 | A15 | B1 | 99.0 | 1.0 | A | A | No problem |
| | C16 | A16 | B1 | 99.3 | 0.7 | A | B | No problem |
| | C17 | A17 | B1 | 99.0 | 1.0 | A | A | No problem |
| | C18 | A18 | B1 | 99.1 | 0.9 | A | A | No problem |
| Comparative Example | c1 | a1 | B2 | 96.9 | 3.1 | C | A | Bubble generated |
| | c2 | a2 | B2 | 97.1 | 2.9 | C | A | Bubble and black point generated |
| | c3 | a3 | B2 | 97.2 | 2.8 | C | A | No problem |
| | c4 | a4 | B2 | 97.4 | 2.6 | C | A | No problem |
| | c5 | a5 | B2 | 97.1 | 2.9 | C | C | No problem |
| | c6 | a6 | B2 | 96.7 | 3.3 | C | C | Bubble and black point generated |
| | c7 | a7 | B2 | 96.8 | 3.2 | C | B | No problem |
| | c8 | a8 | B2 | 97.3 | 2.7 | C | B | No problem |
| | c9 | a9 | B2 | 95.6 | 4.4 | C | B | No problem |
| | c10 | a10 | B2 | 97.2 | 2.8 | C | B | No problem |
| | c11 | a11 | B2 | 96.5 | 3.5 | C | A | No problem |
| | c12 | a12 | B2 | 96.4 | 3.6 | C | B | No problem |
| | c13 | a13 | B2 | 96.8 | 3.2 | C | B | No problem |
| | c14 | a14 | B2 | 97.3 | 2.7 | C | A | No problem |
| | c15 | a15 | B2 | 96.4 | 3.6 | C | A | Black point generated |
| | c16 | a16 | B2 | 97.1 | 2.9 | C | C | No problem |
| | c17 | A17 | B2 | 96.8 | 3.2 | C | A | No problem |
| | c18 | A18 | B2 | 97.3 | 2.7 | C | A | No problem |
| | c19 | a9 | B1 | 96.2 | 3.8 | C | B | No problem |
| | c20 | a12 | B1 | 97.3 | 2.7 | C | B | No problem |

In the obtained steel sheets, oxides that were present in a 10 mm×10 mm range on a plane parallel to the surface of the steel sheet at a position of t/4 in the sheet thickness direction from the surface were analyzed using Metals Quality Analyzer (MQA: registered trademark), and the proportion of oxides having a major axis of more than 1.0 μm, the number density of MnO and $Cr_2O_3$ having a major axis of more than 1.0 μm and 10 μm or less, and the number density of MnO having a major axis of 0.1 to 1.0 μm were measured.

The results are shown in Table 4.

In addition, for the obtained steel sheets, the enamel characteristics (fish scaling resistance, enamel adhesion, and external appearance after an enameling treatment) were evaluated in the same manner as in Example 1. In addition, decreases in the tensile strengths due to enameling treatments were measured as described below. The results are shown in Table 4.

[Tensile Strength Before and After Enameling Treatment]

The tensile strengths of the obtained steel sheets were measured. The tensile strengths (TS) were measured by carrying out a tensile test according to JIS Z 2241: 2011 using a JIS No. 5 test piece.

In addition, a heat treatment simulating an enameling treatment at a furnace temperature of 830° C. for 5 minutes was carried out on the obtained steel sheets, and a tensile test was carried out in the same manner as described above to determine the tensile strengths.

From the results, the proportions of the strength after the heat treatment in the strength before the heat treatment was calculated.

In a case where the tensile strength after the heat treatment was 0.85 (85%) or more of the tensile strength before the heat treatment, it is determined that a decrease in strength due to the enameling treatment could be stably suppressed.

As is clear from Table 1, Table 2, and Table 4, in a case where the total number density of MnO and $Cr_2O_3$ having a major axis of more than 1.0 μm and 10 μm or less was $5.0\times10^2/mm^2$ or more and $5.0\times10^4/mm^2$ or less, the fish scaling resistance was also evaluated as B or higher, and, in a case where the total number density of MnO and $Cr_2O_3$ having a major axis of more than 1.0 μm and 10 μm or less was $1.0\times10^3/mm^2$ or more, the fish scaling resistance was evaluated as A.

In addition, in a case where the number density of the MnO oxide having a major axis of 0.1 to 1.0 μm was within an appropriate range, a decrease in tensile strength due to the enameling treatment was further suppressed. In particular, as the number density became larger, the decrease in tensile strength became smaller. In addition, the MnO oxide having a major axis of 0.1 to 1.0 μm was substantially spherical.

Example 3

Cr, Mn, and Al were added in the addition order shown in the refining No. B1 in Table 2, and slabs having a chemical composition of Steel No. A3, A8, A9, All, A17, or A18 in Table 1 were obtained.

From these slabs, steel sheets were manufactured under the same conditions as in Example 1.

For the obtained steel sheets, the proportions of oxides having a major axis of more than 1.0 μm and the number densities of MnO and $Cr_2O_3$ having a major axis of more than 1.0 μm and 10 μm or less were measured in the same manner as in Example 2.

The results are shown in Table 5.

In addition, for the obtained steel sheets, the enamel characteristics (fish scaling resistance, enamel adhesion, and external appearance after an enameling treatment) were evaluated in the same manner as in Example 1. The results are shown in Table 5.

TABLE 4

| | | | | Area ratio of oxides having major axis of more than 1.0 μm | | Number density of oxides having major axis of more than 1.0 μm and 10 μm or less | Number density of oxides having major axis of 0.1 to 1.0 μm | Enamel characteristics | | | Decrease in tensile strength due to enameling treatment |
|---|---|---|---|---|---|---|---|---|---|---|---|
| | Sign | Steel No. | Refining No. | MnO + $Cr_2O_3$ (%) | $Al_2O_3$ (%) | MnO + $Cr_2O_3$ (molecules/$mm^2$) | MnO (molecules/$mm^2$) | Fish scaling resistance | Adhesion | External appearance | (TS after enamel baking/TS before enameling) |
| Invention Example | D1 | A5 | B1 | 98.8 | 1.2 | $8.7 \times 10^2$ | $1.8 \times 10^2$ | B | B | No problem | 0.91 |
| | D2 | A11 | B1 | 98.8 | 1.2 | $4.5 \times 10^4$ | $2.3 \times 10$ | A | B | No problem | 0.87 |
| | D3 | A17 | B1 | 99.0 | 1.0 | $3.8 \times 10^3$ | $8.9 \times 10$ | A | A | No problem | 0.89 |
| | D4 | A9 | B1 | 98.1 | 1.9 | $6.2 \times 10^2$ | $3.6 \times 10^2$ | B | B | No problem | 0.95 |

TABLE 5

| | Sign | Steel No. | Refining No. | Area ratio of oxides having major axis of more than 1.0 μm: $MnO + Cr_2O_3$ (%) | Area ratio of oxides having major axis of more than 1.0 μm: $Al_2O_3$ (%) | Number density of oxides having major axis of more than 1.0 μm and 10 μm or less: $MnO + Cr_2O_3$ (molecules/mm$^2$) | Component ratio [Cu]/[P] | Component ratio [P]/[S] | Enamel characteristics: Fish scaling resistance | Enamel characteristics: Adhesion | Enamel characteristics: External appearance |
|---|---|---|---|---|---|---|---|---|---|---|---|
| Invention Example | E1 | A8 | B1 | 99.0 | 1.0 | $1.1 \times 10^3$ | 1.0 | 0.6 | A | A | No problem |
| | E2 | A3 | B1 | 99.1 | 0.9 | $7.9 \times 10^3$ | 4.0 | 0.6 | A | A | No problem |
| | E3 | A9 | B1 | 98.1 | 1.9 | $6.2 \times 10^2$ | 3.8 | 0.1 | B | B | No problem |
| | E4 | A11 | B1 | 99.3 | 0.7 | $3.3 \times 10^3$ | 0.8 | 1.3 | A | B | No problem |
| | E5 | A17 | B1 | 99.0 | 1.0 | $3.8 \times 10^4$ | 2.3 | 0.7 | A | A | No problem |
| | E6 | A18 | B1 | 99.1 | 0.9 | $7.1 \times 10^3$ | 1.8 | 1.5 | A | A | No problem |

As is clear from Table 1, Table 2, and Table 5, in a case where [Cu]/[P] was 1.0 to 4.0 and [P]/[S] was 0.2 to 2.0, the enamel adhesion was more superior.

INDUSTRIAL APPLICABILITY

According to the present invention, it is possible to provide a steel sheet being excellent in terms of fish scaling resistance after an enameling treatment, enamel adhesion, and external appearance after an enameling treatment. This steel sheet is preferable as a steel sheet for vitreous enameling that is a substrate for enameled products that are applied to kitchen appliances, building materials, energy fields, and the like. Therefore, the present invention is highly industrially applicable.

The invention claimed is:

1. A steel sheet comprising, as a chemical composition, by mass %:

C: 0.0050% or less;
Si: 0.050% or less;
Mn: 0.007% to 1.00%;
P: 0.003% to 0.050%;
S: 0.005% to 0.050%;
Al: 0.002 to 0.010%;
O: 0.0300% to 0.1000%;
Cu: 0.010% to 0.060%;
N: 0.0050% or less;
Cr: 0.01% to 1.00%; and
a remainder of Fe and an impurity, wherein, on a plane parallel to a surface at a ¼ position of a sheet thickness in a sheet thickness direction from the surface, included oxides consist of one or more oxides consisting of any one of Mn, Cr, Al, Si, and Ca, and O, and with respect to a total area of three types of oxides of MnO, $Cr_2O_3$ and $Al_2O_3$ having a major axis of more than 1.0 μm, a total area ratio of the MnO and the $Cr_2O_3$ is 98.0% or more, and an area ratio of the $Al_2O_3$ is 0.5 to 2.0%, wherein a total number density of the MnO and the $Cr_2O_3$ having a major axis of more than 1.0 μm and 10 μm or less is $5.0\times10^2$/mm$^2$ or more and $5.0\times10^4$/mm$^2$ or less, and wherein a number density of MnO having a major axis of 0.1 to 1.0 μm is $1.0\times10$/mm$^2$ or more and $5.0\times10^2$/mm$^2$ or less.

2. The steel sheet according to claim 1, further comprising, as the chemical composition, by mass %:

a total of 0.100% or less of one or more selected from the group of B, Ni, Nb, As, Ti, Se, Ta, W, Mo, Sn, Sb, La, Ce, Ca, and Mg.

3. The steel sheet according to claim 1, wherein, when, by mass %, a Cu content is indicated by [Cu], a P content is indicated by [P], and a S content is indicated by [S], [Cu]/[P] is 1.0 to 4.0, and [P]/[S] is 0.2 to 2.0.

4. The steel sheet according to claim 1, wherein the steel sheet is a cold-rolled steel sheet.

5. The steel sheet according to claim 1, wherein the steel sheet is a steel sheet for vitreous enameling.

6. An enameled product comprising:

the steel sheet according to claim 1.

7. A steel sheet comprising, as a chemical composition, by mass %:

C: 0.0050% or less;
Si: 0.050% or less;
Mn: 0.007% to 1.00%;
P: 0.003% to 0.050%;
S: 0.005% to 0.050%;
Al: 0.002 to 0.010%;
O: 0.0300% to 0.1000%;
Cu: 0.010% to 0.060%;
N: 0.0050% or less;
Cr: 0.01% to 1.00%; and
a remainder of Fe and an impurity, wherein, on a plane parallel to a surface at a ¼ position of a sheet thickness in a sheet thickness direction from the surface, included oxides consist of one or more oxides consisting of one or more of Mn, Cr, Al, Si, and Ca, and O, and with respect to a total area of three types of oxides of MnO, $Cr_2O_3$ and $Al_2O_3$ having a major axis of more than 1.0 μm, a total area ratio of the MnO and the $Cr_2O_3$ is 98.0% or more, and an area ratio of the $Al_2O_3$ is 0.5 to 2.0%, wherein a total number density of the MnO and the $Cr_2O_3$ having a major axis of more than 1.0 μm and 10 μm or less is $5.0\times10^2$/mm$^2$ or more and $5.0\times10^4$/mm$^2$ or less, and wherein a number density of MnO having a major axis of 0.1 to 1.0 μm is $1.0\times10$/mm$^2$ or more and $5.0\times10^2$/mm$^2$ or less.

* * * * *